US008779663B2

(12) United States Patent
Nguyen et al.

(10) Patent No.: US 8,779,663 B2
(45) Date of Patent: Jul. 15, 2014

(54) LIGHT-EMITTING DIODE AND METHOD FOR PRODUCING A LIGHT-EMITTING DIODE

(75) Inventors: Francis Nguyen, Millbrae, CA (US); John McNatt, San Jose, CA (US); Sven Weber-Rabsilber, Neutraubling (DE); Peter Brick, Regensburg (DE)

(73) Assignee: OSRAM Opto Semiconductors GmbH (DE)

( * ) Notice: Subject to any disclaimer, the term of this patent is extended or adjusted under 35 U.S.C. 154(b) by 112 days.

(21) Appl. No.: 13/395,552

(22) PCT Filed: Sep. 25, 2009

(86) PCT No.: PCT/US2009/058305

§ 371 (c)(1),
(2), (4) Date: Apr. 11, 2012

(87) PCT Pub. No.: WO2011/037570

PCT Pub. Date: Mar. 31, 2011

(65) Prior Publication Data

US 2012/0187846 A1 Jul. 26, 2012

(51) Int. Cl.
*H05B 37/02* (2006.01)

(52) U.S. Cl.
USPC ..... 315/121; 315/247; 315/291

(58) Field of Classification Search
None
See application file for complete search history.

(56) References Cited

U.S. PATENT DOCUMENTS

| | | | |
|---|---|---|---|
| 5,717,417 | A | 2/1998 | Takahashi et al. |
| 6,825,828 | B2 | 11/2004 | Burke et al. |
| 7,262,752 | B2 | 8/2007 | Weindorf |
| 2005/0052378 | A1 | 3/2005 | Hacker |
| 2007/0052983 | A1 | 3/2007 | Nakajima |
| 2007/0097045 | A1 | 5/2007 | Lee et al. |
| 2007/0115662 | A1 | 5/2007 | Roberts et al. |
| 2008/0012125 | A1 | 1/2008 | Son |
| 2008/0180414 | A1 | 7/2008 | Fung et al. |
| 2008/0225520 | A1* | 9/2008 | Garbus ..... 362/231 |
| 2008/0238860 | A1 | 10/2008 | Onodera |
| 2013/0069554 | A1 | 3/2013 | Kawata et al. |

FOREIGN PATENT DOCUMENTS

| | | |
|---|---|---|
| EP | 1 194 013 A1 | 4/2002 |
| JP | 62-108587 | 5/1987 |
| JP | 5-273939 | 10/1993 |
| JP | 8-30231 | 2/1996 |

(Continued)

OTHER PUBLICATIONS

"6-lead MULTILED® Enhanced optical Power LED (HOP2000 / ATON®) Lead (Pb) Free Product—RoHS Compliant," OSRAM Opto Semiconductors GmbH, Oct. 5, 2007, pp. 1-21.

"16-Channel, 12-Bit PWM LED Driver with 6-Bit Dot Correction and Pre-Charge FET," Texas Instruments Inc., www.ti.com, Jun. 2008-Revised Jul. 2009, pp. 1-37.

The Japanese Examination Report issued on Oct. 7, 2013 in corresponding Japanese Patent Application No. 2012-530851.

(Continued)

*Primary Examiner* — Jany Richardson
(74) *Attorney, Agent, or Firm* — DLA Piper LLP (US)

(57) ABSTRACT

A light-emitting diode includes at least one light-emitting diode chip, at least one control device, wherein each of the light-emitting diode chips is electrically connected to one of the at least one control devices, each of the at least one control devices including a data storage device in which brightness data for each light-emitting diode chip which is connected to the control device is stored, and the control device drives the connected light-emitting diode chip with a current which is selected according to stored brightness data for the light emitting-diode chip.

14 Claims, 11 Drawing Sheets

(56) References Cited

FOREIGN PATENT DOCUMENTS

| | | |
|---|---|---|
| JP | 2006-54337 | 2/2006 |
| JP | 2007-122001 | 5/2007 |
| JP | 2008-22006 | 1/2008 |
| JP | 2008-34841 | 2/2008 |
| JP | 2009-44081 | 2/2009 |
| TW | 2008-25392 | 6/2008 |

OTHER PUBLICATIONS

The Examination Report issued by the Taiwanese PatentOffice on Aug. 6, 2013 in corresponding Taiwanese Application No. 099130610.

English translation of the Japanese Notification of Reasons for Refusal dispatched May 7, 2014 from corresponding Japanese Patent Application No. 2012-530851.

* cited by examiner

SINGLE CHANNEL PROGRAMMABLE CURRENT SOURCE CONNECTION

LIGHT-EMITTING DIODE AND METHOD FOR PRODUCING A LIGHT-EMITTING DIODE

RELATED APPLICATIONS

This is a §371 of International Application No. PCT/US2009/058305, with an international filing date of Sep. 25, 2009 (WO 2011/037570 A1, published Mar. 31, 2011), the subject matter of which is incorporated by reference.

TECHNICAL FIELD

This disclosure relates to light emitting-diodes and methods for producing light-emitting diodes.

BACKGROUND

Light-emitting diodes are analog devices in that their output, i.e., the brightness or the luminous intensity of the emitted light, is dependent on the analog value of the input current. A variation of this operation mode is to use a fixed value of the forward current, i.e., a constant current value, and then to vary the duration of the forward current by pulse-width modulation (PWM) to change the duty cycle which is proportional to the LED output.

Typical light-emitting diodes delivered to video display makers are selected light-emitting diodes with a floating single bin in brightness with a combined single wavelength group. These pre-sorted light-emitting diodes are often inadequate to provide the necessary homogeneity in color and brightness. The brightness bin is usually between 30% and 60% wide, the wavelength bin is usually between 4 nm and 5 nm wide.

It could therefore be helpful to provide a light-emitting diode which has a predetermined luminous intensity at a predetermined emission wavelength and a method for producing such a light-emitting diode.

SUMMARY

We provide light-emitting diodes including at least one light-emitting diode chip, at least one control device, wherein each of the light-emitting diode chips is electrically connected to one of the at least one control devices, each of the at least one control devices includes a data storage device in which brightness data for each light-emitting diode chip which is connected to the control device is stored, and the control device drives the connected light-emitting diode chip with a current which is selected according to stored brightness data for the light-emitting diode chip.

We also provide a method for producing the light-emitting diode including the following steps: a) sending an electrical test pulse to a data input of one of the at least one control devices for one of the at least one light-emitting diode chips, b) measuring luminous intensity of light emitted by light-emitting diode chips due to the test pulse, c) calculating a correction data wherein a value of the correction data is proportional to a difference between the measured luminous intensity and a target luminous intensity, d) storing the correction data in the data storage device, e) repeating the steps a) to d) until the measured luminous intensity matches the target luminous intensity, and f) repeating the steps a) to e) for all light-emitting diode chips.

We further provide a light-emitting diode including at least one light-emitting diode chip, at least one control device, a carrier for the at least one light-emitting diode chip, wherein each of the light-emitting diode chips is electrically connected to one of the at least one control devices, each of the at least one control devices includes a data storage device in which brightness data for each light-emitting diode chip which is connected to the control device is stored, the control device drives the connected light-emitting diode chip with a current selected according to stored brightness data for the light emitting-diode chip, and the at least one control device is integrated into the carrier or the at least one control device is the carrier.

BRIEF DESCRIPTION OF THE DRAWINGS

Our representative light-emitting diodes are described in more detail with regard to examples and respective figures of the examples.

DETAILED DESCRIPTION

Figure 1A:
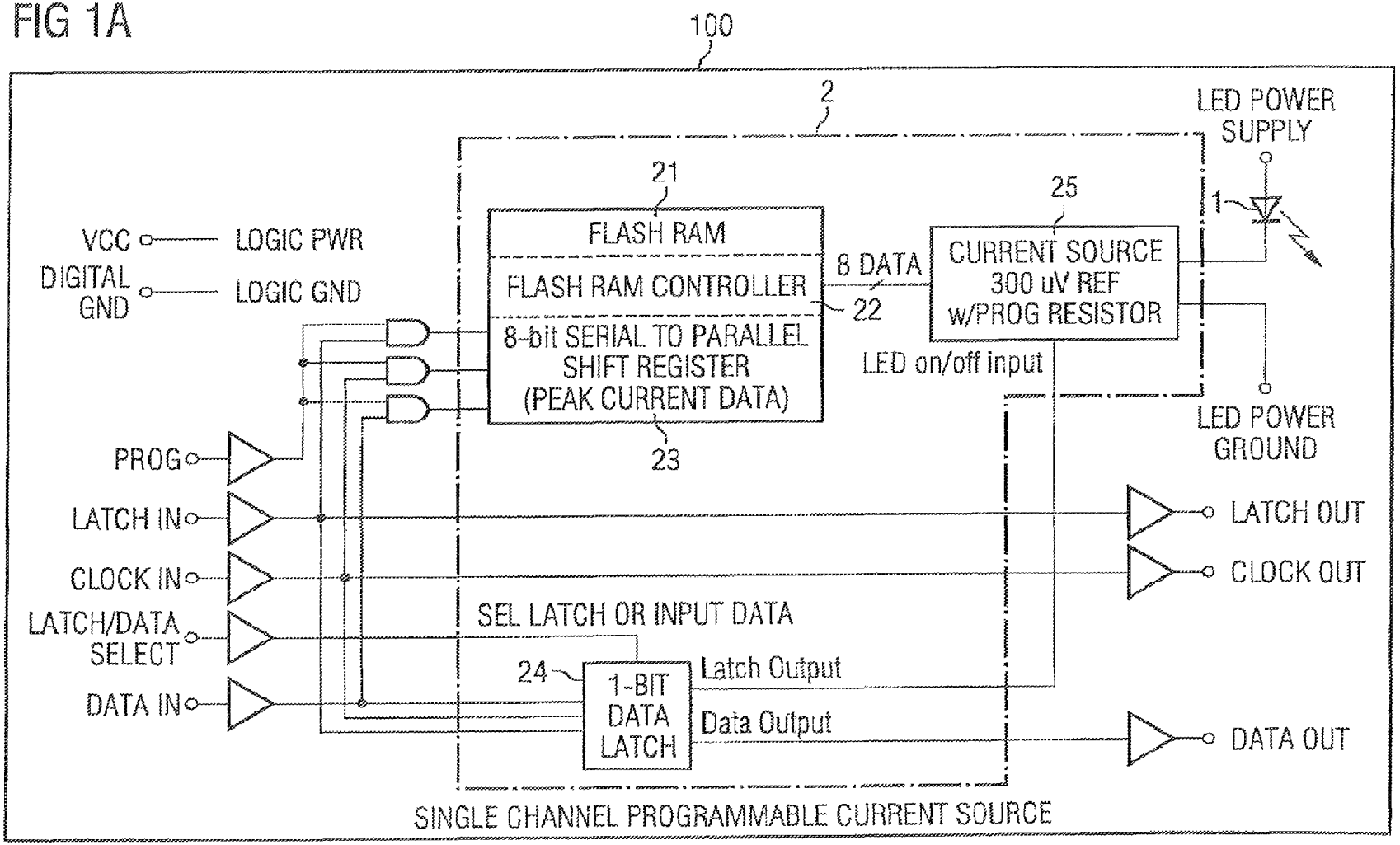
FIGS. 1A and 1B show schematic circuit diagrams of light-emitting diodes and arrangements of light-emitting diodes.

The light-emitting diode may comprise at least one light-emitting diode chip. The at least one light-emitting diode chip emits light during operation. For example, the light-emitting diode may comprise at least one light-emitting chip which emits red light, at least one light-emitting chip which emits blue light and at least one light-emitting chip which emits green light during operation of the light-emitting diode.

The light-emitting diode may comprise at least one control device. The control device may drive at least one of the light-emitting diode chips during operation of the light-emitting diode. For example, each of the light-emitting diode chips is electrically connected to one of the at least one control devices. For example, it is possible that all light-emitting diode chips of the light-emitting diode are connected with a single control device. Further, it is possible that each light-emitting diode chip is connected to its own control device which only drives this light-emitting diode chip. Finally, it is also possible that light-emitting diode chips of the same color are connected to the same control device and light-emitting chips of different color are connected to different control devices.

Each of the at least one control devices may comprise data storage means in which brightness data for each light-emitting diode chip which is connected to the control device is stored. For example, the data storage means may comprise or consist of a non-volatile flash random access memory. The brightness data for each light-emitting diode chip is, for example, the luminous intensity of each light-emitting diode chip or a value which depends on the luminous intensity of each light-emitting diode chip.

The control device may drive the connected light-emitting diode chip with a current which is chosen according to the stored brightness data for the light-emitting diode chip. For example, an intensity of the current is chosen according to the stored brightness data. Alternatively, it is also possible that a duty cycle is chosen according to the stored data. In this case, the control device comprises a pulse-with-modulation circuit which drives the connected light-emitting diode chip with pulse current at a duty cycle depending on the brightness data stored in the data storage means of the control device.

The light-emitting diode may comprise at least one light-emitting diode chip and at least one control device, wherein each of the light-emitting diode chips is electrically connected to one of the at least one control devices, each of the at least one control devices comprising data storage means in which brightness data for each light-emitting diode chip which is connected to the control device is stored and the control device drives the connected light-emitting diode chip with a current which is chosen according to the stored brightness data for the light-emitting diode chip.

For example, the light-emitting diode comprises a control device which has an internal flash random access memory for non-volatile storage of calibration data. As a consequence, the need to keep track of calibration data is eliminated. After calibration, when the light-emitting diode is driven with a specified input, the output will be within the test tolerance of the targeted brightness value. Consequently, the light-emitting diode has a predetermined luminous intensity. Additionally, the light-emitting diode chips of the light-emitting diode are sorted or binned with respect to the peak wavelength of the emitted radiation. Consequently, the light-emitting diode has a preset brightness and a known wavelength.

The described light-emitting diode is particularly suited as a backlight of a display (e.g., an LCD display).

Further, the light-emitting diode is particularly suited to form a large display, where each pixel or each subpixel of the display is formed by a light-emitting diode.

The light-emitting diode provides both cost savings and design simplification, shortened design lead time for the display maker and eliminates the need for costly pixel calibration by the display maker.

The light-emitting diode may comprise a constant current power supply for driving the connected light-emitting diode chip with a constant current. For example, this constant current depends on the brightness data stored in the control device for the driven light-emitting diode chip.

The light-emitting diode comprises a thermal sensor which performs thermal shutdown of the light-emitting diode. The thermal shutdown of the light-emitting diode is performed if one of the at least one light-emitting diode chips which is connected to the control device exceeds a safe operating temperature.

At least one of the control devices may comprise an open and/or short circuit detection device for the connected light-emitting diode chip. In other words, the control device is able to detect if a connected light-emitting diode chip is broken.

The control device is able to signal information about the functional status of the connected light-emitting diode chip to the outside of the light-emitting diode. For example, the control device has a data port for the output of functional status data of the connected light-emitting diode chip, like the temperature of the light-emitting diode chip.

At least one or each of the at least one control devices may comprise protection against electrostatic discharge (ESD protection) for the connected light-emitting diode chip. In this case, further ESD protection of the light-emitting diode chips—for example, a protective diode—is redundant.

Each of the at least one control devices may comprise a temperature compensation circuit for the connected light-emitting diode chip which adjusts the current supplied to the light-emitting diode chip according to its operating temperature.

For example, if the operating temperature rises, the temperature compensation circuit of the control device is able to lower the current which is supplied to the light-emitting diode chip to reduce the waste heat produced by the light-emitting diode chip.

However, it is also possible that the temperature compensation circuit of the control device is able to increase the current which is supplied to the light-emitting diode chip if the operating temperature rises to keep the luminosity of the emitted light constant. The compensation circuit of the control device then increases the current until a given maximum temperature of the light-emitting diode chip is reached.

The light-emitting diode may further comprise a carrier for the at least one light-emitting diode chip. For example, all light-emitting diode chips of the light-emitting diode may be arranged on the carrier. It is possible that the at least one control device is also arranged on the carrier. It is further possible that the at least one control device is integrated into the carrier.

In this case, the carrier is, for example, formed with silicon and at least one of the mentioned circuits or features is integrated into the silicon carrier. Finally, it is further possible that the carrier itself is the control device. For example, the control device is given by a CMOS chip on which the at least one light-emitting diode chip is mounted. In this case, the light-emitting diode chip can be in direct physical contact with the control device. For example, the light-emitting diode chip is attached to the control device by a connecting material such as an adhesive, a solder or the like.

The light-emitting diode may comprise at least three light-emitting diode chips and a single control device for all light-emitting diode chips, wherein the light-emitting diode chips emit light of mutually different color. For example, the light-emitting diode chips emit red, green and blue light.

The light-emitting diode may comprise at least three light-emitting diode chips, wherein each of the light-emitting diode chips is connected to its own control device. Thereby, the light-emitting diode chips emit light of mutually different color. In this case, it is also possible that all light-emitting diode chips which emit light of the same color are connected to the same control device, whereas light-emitting diode chips of other colors are connected to other control devices.

Further, methods for producing a light-emitting diode are provided. The method may comprise the following steps:

- In a first step, a light-emitting diode comprising at least one light-emitting diode chip and at least one control device is provided, wherein each of the light-emitting diode chips is electrically connected to one of the at least one control devices, and the control device is equipped to drive the connected light-emitting diode chip with a current which is chosen according to a stored brightness data for the light-emitting diode chip.
- Then, an electrical test pulse is sent to the data input of one of the at least one control devices for one of the at least one light-emitting diode chips. The test pulse causes one of the light-emitting diode chips to emit radiation.
- In a further step, the luminous intensity of the light emitted by the light-emitting diode chip is measured.
- Subsequently, correction data is calculated wherein the value of the correction data depends on the difference between the measured luminous intensity and a target luminous intensity which should be reached by the light-emitting diode chip. For example, the value of the correction data is proportional to the difference between the measured luminous intensity and a target luminous intensity which should be reached by the light-emitting diode chip.
- In a further method step, the corrected data is stored into the data storage means of the control device.

The steps from sending the electrical test pulse to storing the correction data into the data storage means of the control device are repeated until the measured luminous intensity matches the target luminous intensity. A match of both luminous intensities is, for example, reached if the deviation between the measured intensity and the target intensity is smaller than or equal to 10%, preferably 2%.

The method steps may be repeated for all light-emitting diode chips. As a result, brightness values for all light-emitting diode chips are stored in the storage means of the at least one control device and, consequently, the control device is able to drive the connected light-emitting diode chips with a current which is chosen according to the stored brightness data and each light-emitting diode chip emits radiation with its target luminous intensity.

With the described method, it is possible to produce a large number of light-emitting diodes which have the same luminous intensity.

The correction data which is stored in the data storage means may be an 8-bit correction data pulse. The test pulse which is sent to the data input of one of the at least one control devices is, for example, a pulse with a pulse length of 25 ms.

Light-emitting diodes which can be produced with the methods have the following advantages: the light-emitting diode can be delivered to the customer with a tight tolerance brightness and known wavelength group which simplifies the design and the test, for example, of displays equipped with the described light-emitting diodes. Furthermore, the overall display circuit board can be simplified as a number of external components can be eliminated due to the control device which is integrated into the light-emitting diode.

Turning now to the drawings, in the structures/forms, similar or similarly acting constituent parts are provided with the same reference symbols. The elements illustrated in the figures and their size relationships among one another should not be regarded as true to scale unless otherwise indicated. Rather, individual elements may be represented with an exaggerated size for the sake of better presentability and/or for the sake of better understanding.

FIG. 1A shows a schematic circuit diagram of one example of a light-emitting diode 100. The light-emitting diode 100 comprises one light-emitting diode chip 1 which emits visible light. For example, the light-emitting diode chip 1 emits white light.

The light-emitting diode 100 further comprises a control device 2. The control device 2 comprises data storage means/a data storage device 21 which are, for example, given by a flash random access memory. The control device further comprises a controller for the flash random access memory 22 and a serial to parallel shift register 23 for accessing the data storage means 21.

The control device further comprises a 1-bit data latch 24 for switching the constant current source 25 and, therefore, for switching the light-emitting diode chip 1.

Constant current source 25 and data storage means 21 are connected via a data line which sends an 8-bit data pulse to the constant current source which represents the brightness value stored in the data storage means 21 for the light-emitting diode chip 1. In other words, the constant current source 25 supplies the light-emitting diode chip 1 with a constant current such that the light-emitting diode chip 1 emits light with a luminous intensity as stored in the data storage means.

Figures 1, 1B:
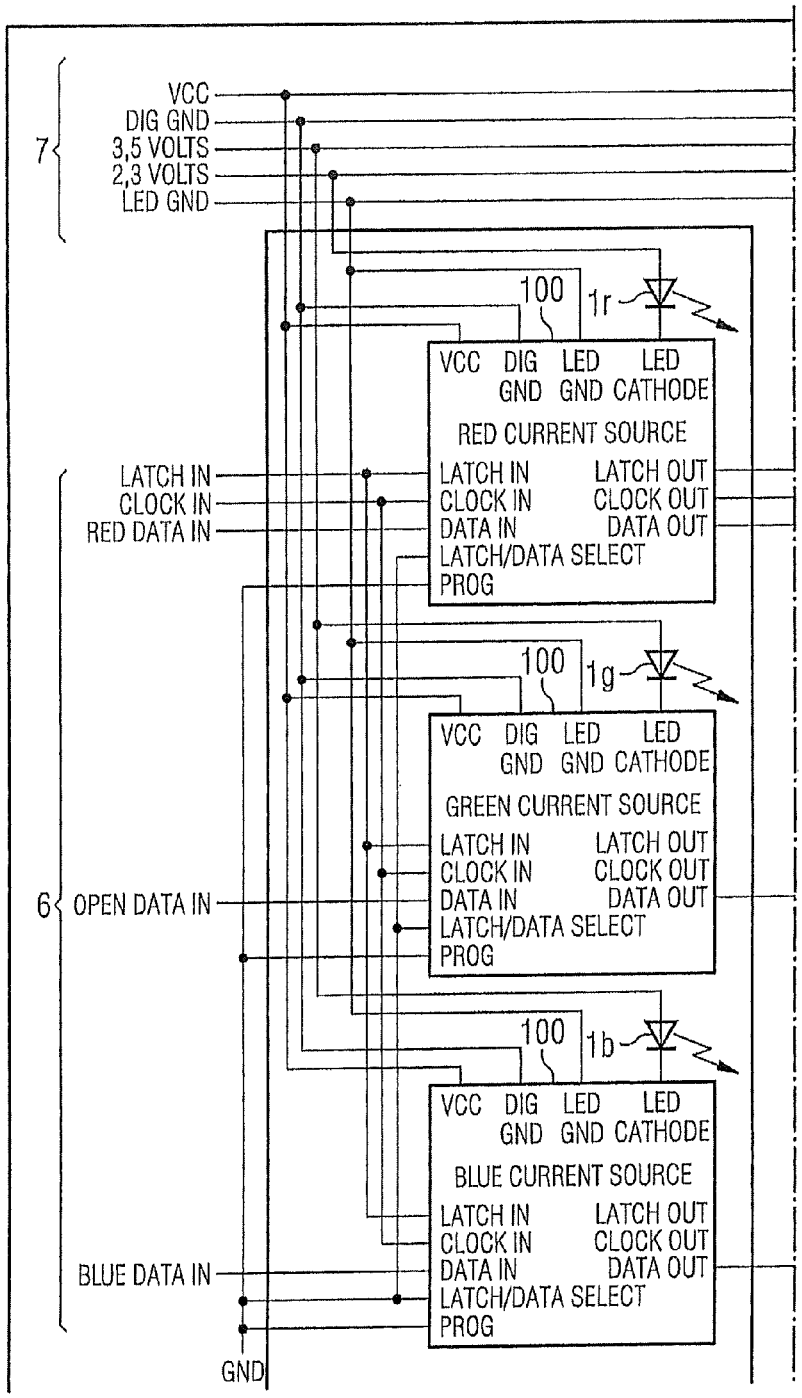
Figures 1, 1B, 2:
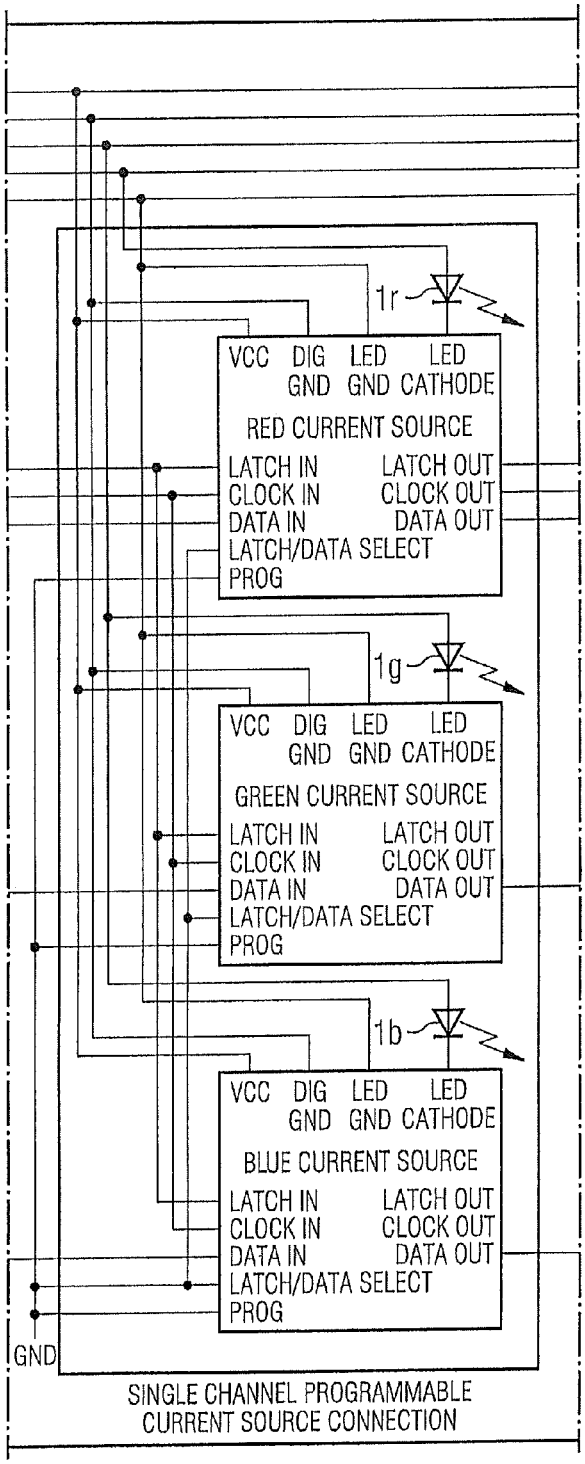

FIG. 1B shows a schematic circuit diagram for an arrangement of nine light-emitting diodes 100 as described in FIG. 1A. The arrangement comprises three red light-emitting diode chips 1*r*, three green light-emitting diode chips 1*g* and three light-emitting diode chips 1*b*.

However, the number of light-emitting diode chips of each color can be smaller or greater. All light-emitting diodes 100 are connected by a data bus system 6. For example, the data bus system 6 is a synchronous serial data interface which offers enough bandwidth necessary in video display applications. If the light-emitting diodes 100 are used in a luminaire, it is also possible that an asynchronous serial interface with a limited bandwidth is used. Such an asynchronous serial interface can also be sufficient for small video displays.

The light-emitting diodes 100 are further connected by a power supply unit 7 which supplies the components of the light-emitting diodes with power. For example, the red light-emitting diodes 1*r* are supplied with less power than the green and the blue light-emitting diodes 1*g*, 1*b*. However, it is also possible to supply all light-emitting diodes with the same power and to use a multiplier.

Figures 1, 2A:
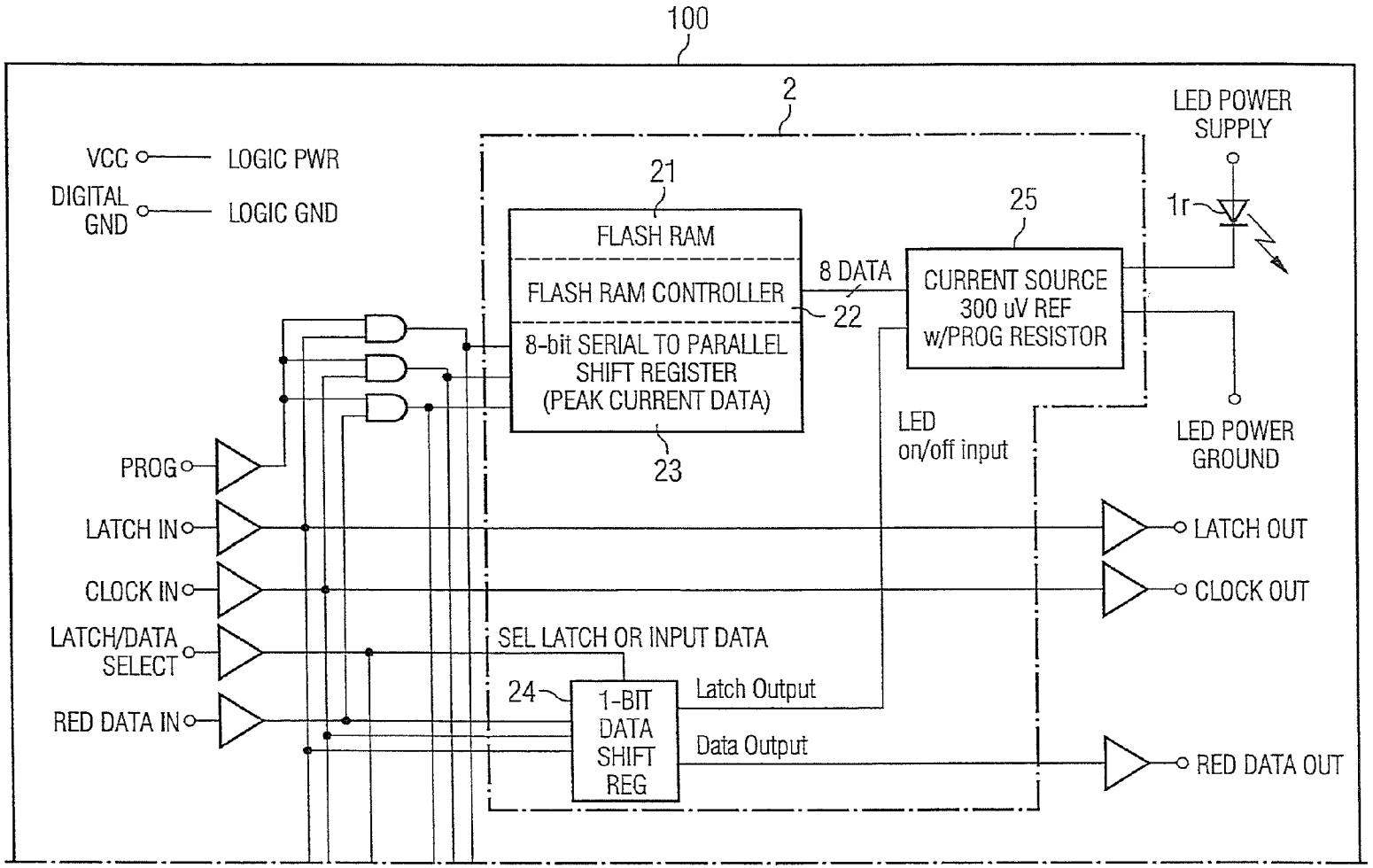
FIGS. 2A and 2B show another set of schematic circuit diagrams of light-emitting diodes and arrangements of light-emitting diodes.
Figures 2, 2A:
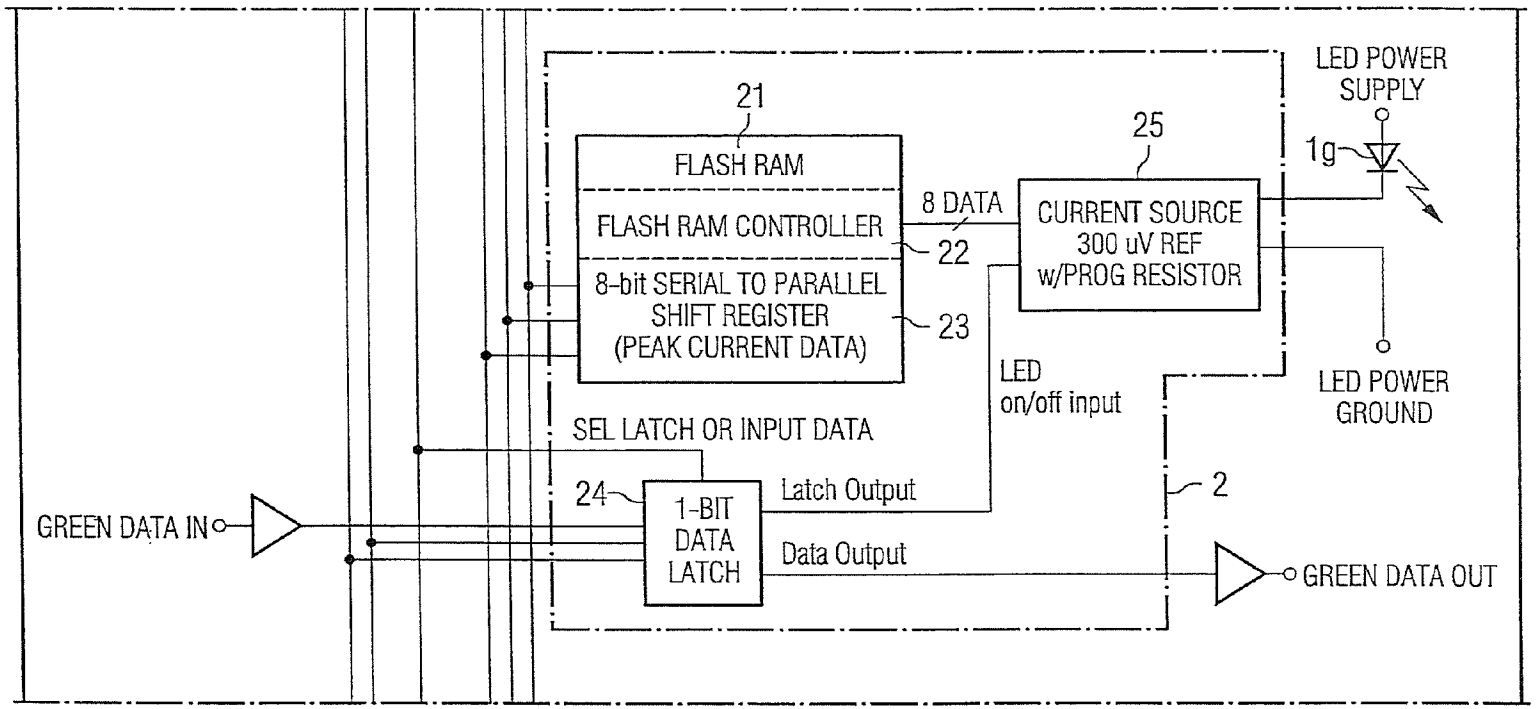
Figures 2, 2A, 3:
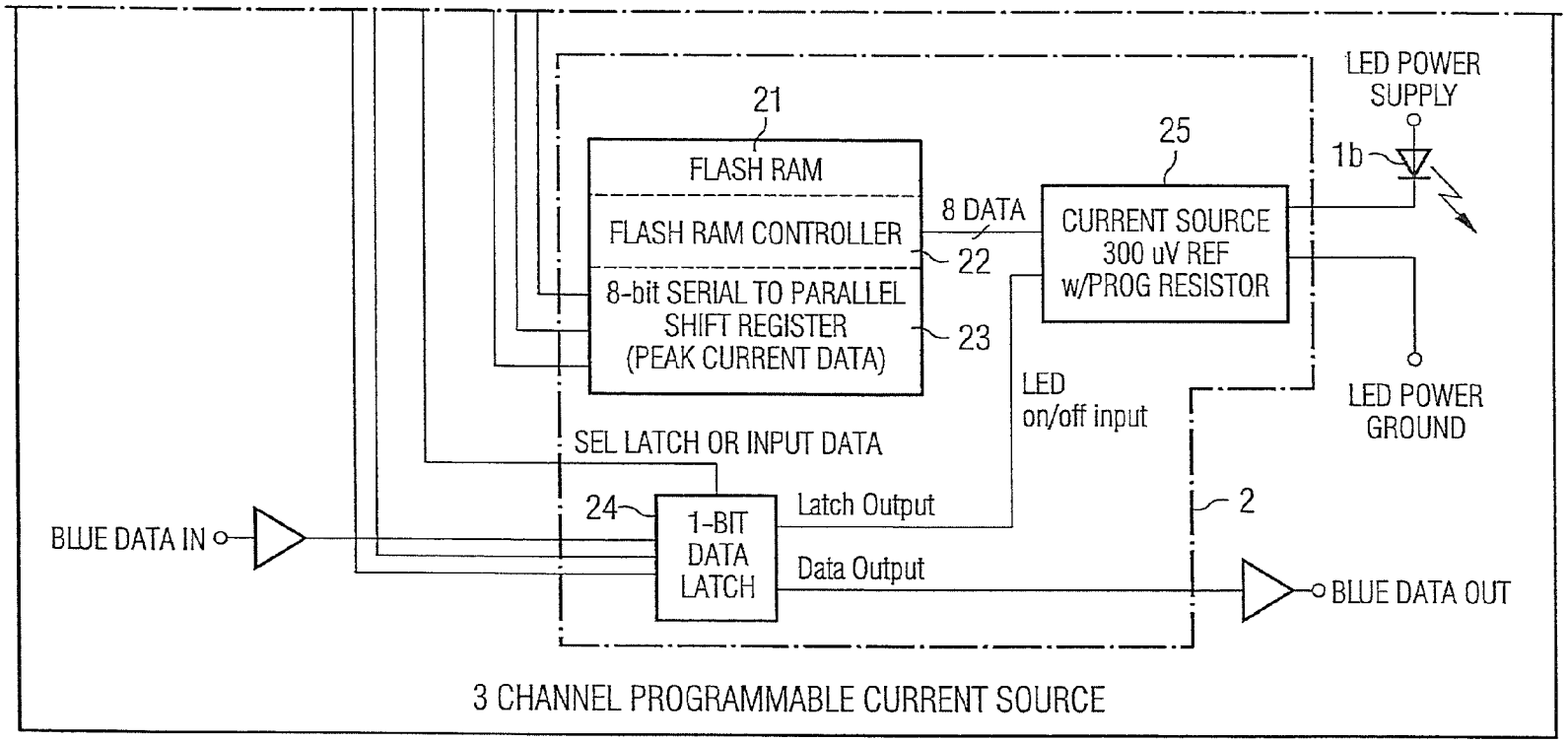

FIG. 2A shows a schematic circuit diagram for a further example of a light-emitting diode 100. The light-emitting diode 100 comprises three light-emitting diode chips 1*r*, 1*g*, 1*b* which emit red, green and blue light. The light-emitting diode 100 comprises a control device 2 for each of the light-emitting diode chips.

Figures 1, 2B:
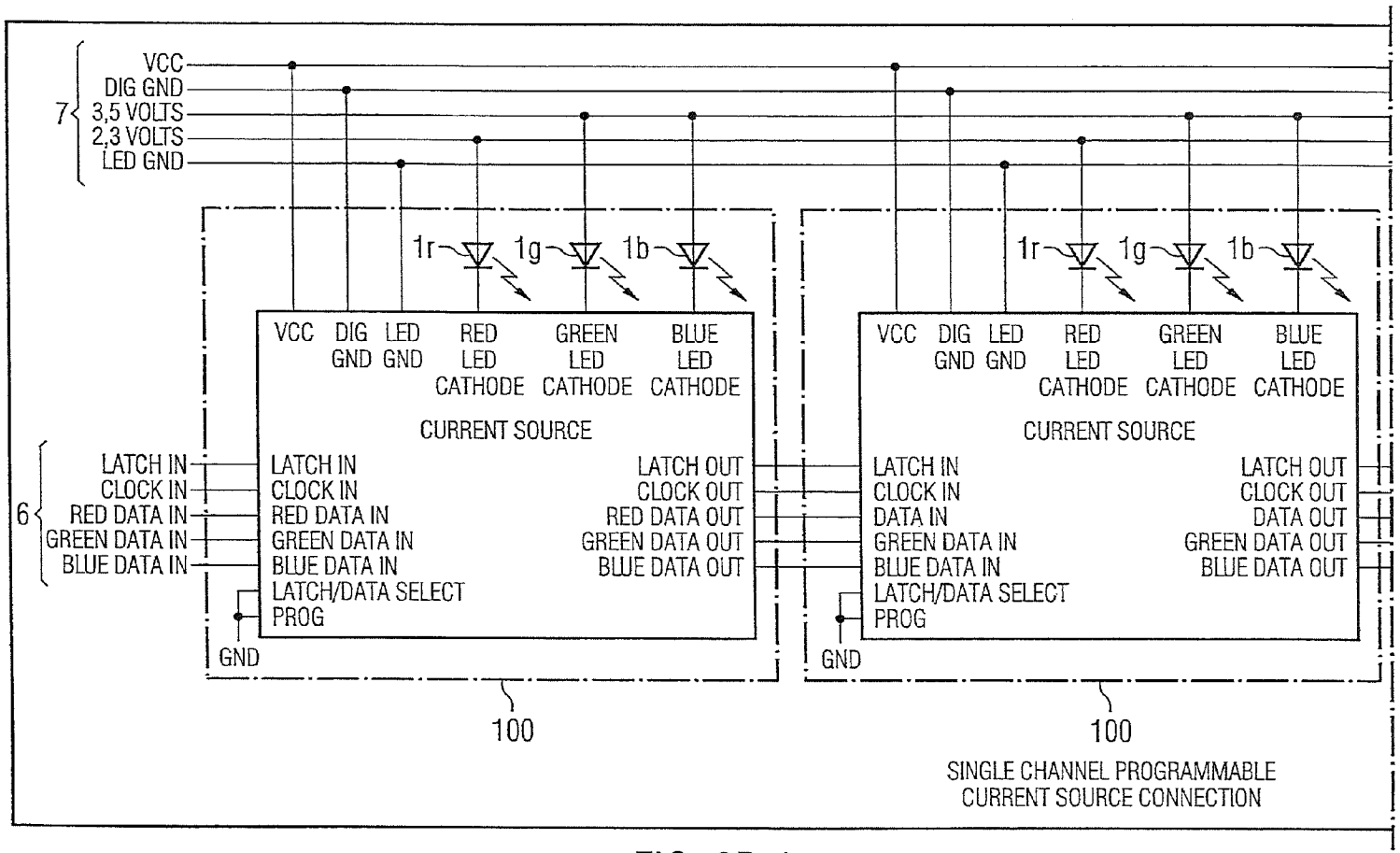
Figures 2, 2B:
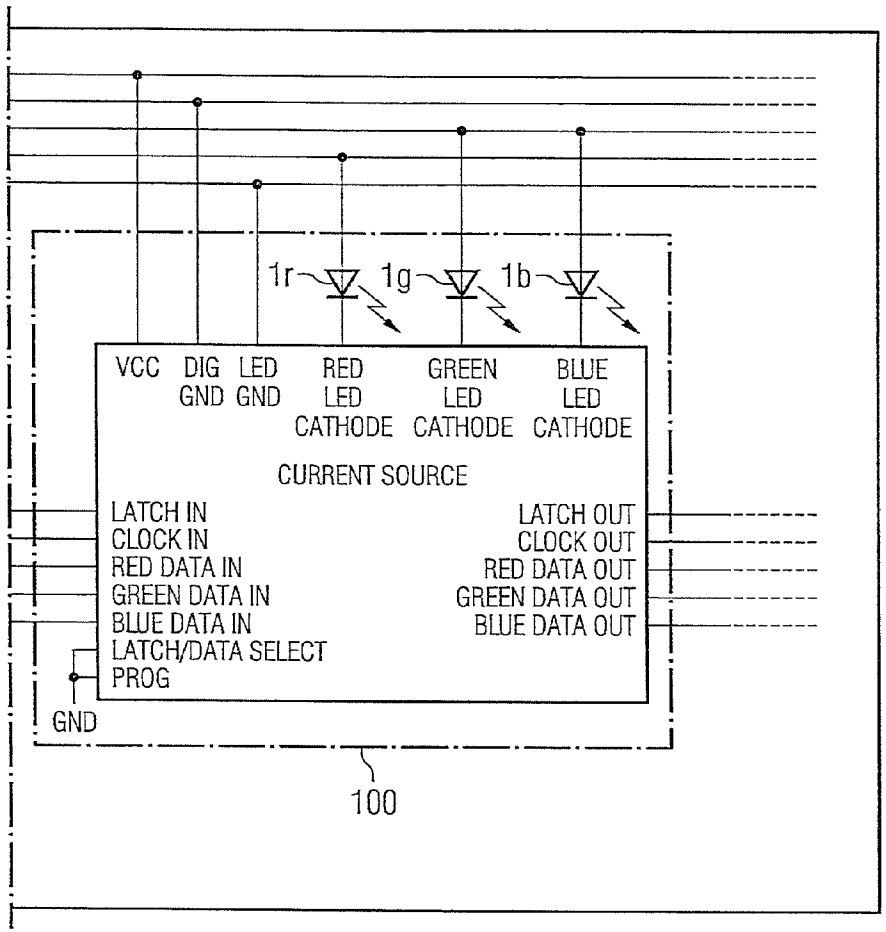
Figure 3:
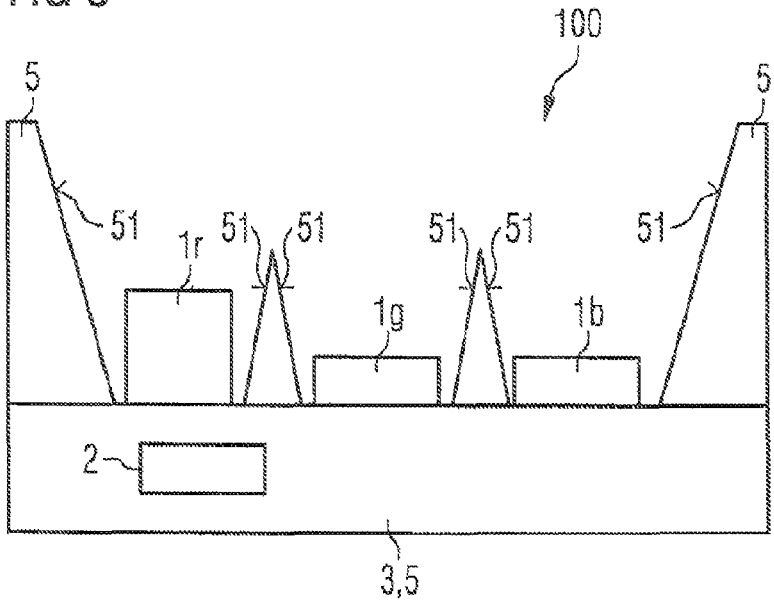

In the arrangement shown in FIG. 2B, it is also possible that, for example, three light-emitting diode chips which emit mutually light of a different color belong to a single light-emitting diode 100. In this case, the light-emitting diode 100 can comprise one control device for three different light-emitting diodes.

Figures 1, 1B, 2, 3:
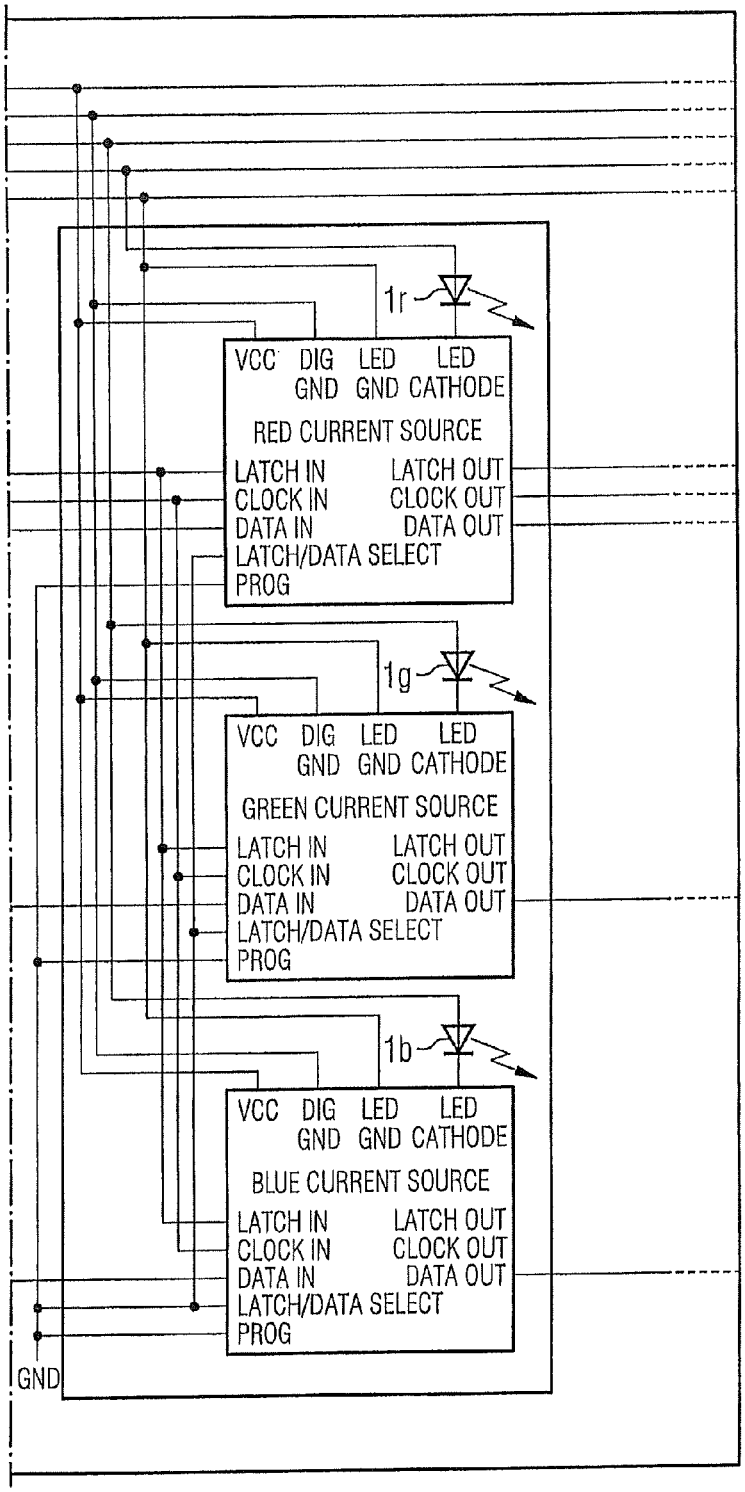
FIG. 3 shows a schematic sectional view of one example of a light-emitting diode.

FIG. 3 shows a schematic sectional view of a further example of a light-emitting diode 100. The light-emitting diode 100 comprises a housing 5. The housing 5, for example, comprises a carrier 3 and reflector walls 51. Three light-emitting diode chips 1*r*, 1*g*, 1*b* are arranged in the housing 5. Further, a single control device 2 for all three light-emitting diode chips 1*r*, 1*g*, 1*b* is integrated into the carrier. For example, the carrier is formed from a silicon and the circuits of the control device 2 are integrated into the silicon carrier. Light emitted by the light-emitting diode chips 1*r*, 1*g*, 1*b* is reflected by the reflector walls 51.

Figure 4:
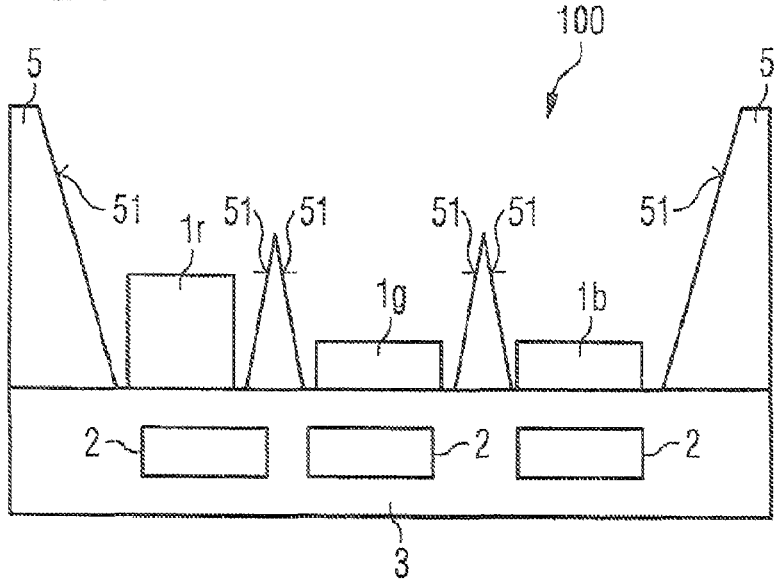
FIG. 4 shows a schematic sectional view of another example of a light-emitting diode.

FIG. 4 shows a schematic sectional view of a further example of a light-emitting diode 100. In contrast to the example of FIG. 3, the light-emitting diode 100 of FIG. 4 comprises three control devices 2. Each control device 2 drives exactly one of the light-emitting diodes 1*r*, 1*g*, 1*b*.

Figure 5:
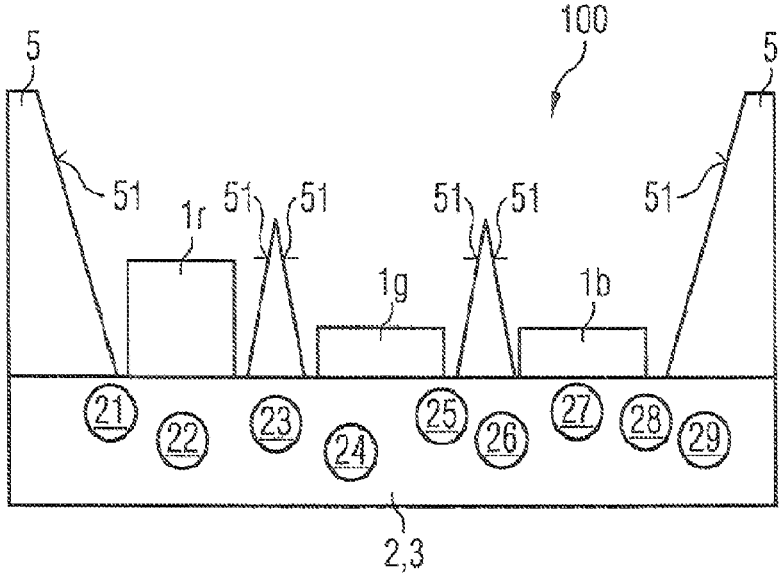
FIG. 5 shows a schematic sectional view of still another example of a light-emitting diode.

A further example of a light-emitting diode 100 is shown in connection with the schematic sectional view of FIG. 5. In this case, carrier 3 is given by the control device 2. For example, the carrier 3 is a CMOS chip on which the light-emitting diode chips 1*r*, 1*g*, 1*b* are arranged. For example, the control device 2 comprises data storage means 21, a data storage controller 22, a serial to parallel shift register 23, a data latch 24, a constant current source 25, a thermal sensor 26, an open and/or short circuit detection device 27, an ESD protection device 28 for each of the light-emitting diodes and a temperature compensation circuit 29.

Figure 6:
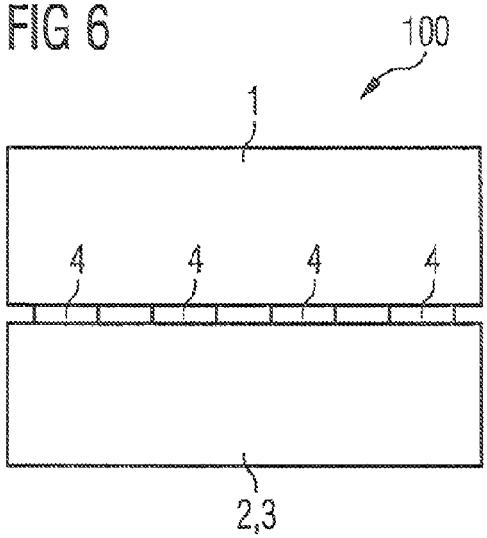
FIG. 6 shows a schematic sectional view of yet another example of a light-emitting diode.

In contrast to the example shown in FIG. 5, the example of the light-emitting diode shown in FIG. 6 has a single light-emitting diode chip 1. The single light-emitting diode chip 1 is arranged on a control device 2 which serves as a carrier for the light-emitting diode chip 1. For example, the control device 2 is a CMOS chip on which the light-emitting diode chip 1 is arranged. For example, connection points 4 of the control device 2 are electrically and mechanically connected to the light-emitting diode chip 1. It is thereby possible that control device 2 and light-emitting diode chip 1 have the same size in a lateral direction so that side faces of the light-emitting diode chip 1 and control device 2 are flush.

This disclosure is not restricted to the representative examples/forms by the description on the basis of those forms. Rather, the disclosure encompasses any new feature and also any combination of features, which in particular comprises any combination of features in the claims and any combination of features in the examples, even if this feature or this combination itself is not explicitly specified in the claims or examples.

The invention claimed is:

1. A light-emitting diode comprising:

at least one light-emitting diode chip, a housing comprising a carrier for the at least one light-emitting diode chip and reflector walls, and at least one control device, wherein each of the light-emitting diode chips is arranged in the housing, the at least one control device is integrated into said carrier, each of the light-emitting diode chips is electrically connected to one of said at least one control devices, each of said at least one control devices comprises a data storage device in which brightness data for each light-emitting diode chip which is connected to said control device is stored, and the control device drives the connected light-emitting diode chip with a current which is selected according to stored brightness data for said light emitting-diode chip.

2. The light-emitting diode according to claim 1, wherein each of said at least one control devices comprises a constant current power supply that drives the connected light-emitting diode chip.

3. The light-emitting diode according to claim 1, wherein each of said at least one control devices comprises a thermal sensor which performs thermal shutdown of the light-emitting diode if one of the at least one light-emitting diode chips connected to the control device exceeds a selected safe operating temperature.

4. The light-emitting diode according to claim 1, wherein each of said at least one control devices comprises an open and/or short circuit detection device for the connected light-emitting diode chip.

5. The light-emitting diode according to claim 1, wherein each of said at least one control devices comprises an ESD protection device for the connected light-emitting diode chip.

6. The light-emitting diode according to claim 1, wherein each of said at least one control devices comprises a temperature compensation circuit for the connected light-emitting diode chip which adjusts the current supplied to the light-emitting diode chip according to its operating temperature.

7. The light-emitting diode according to claim 1, wherein the at least one light-emitting diode chip is in direct contact with at least one of the at least one control devices.

8. The light-emitting diode according to claim 1, comprising at least three light-emitting diode chips and a single control device for all light-emitting diode chips, wherein the light-emitting diode chips emit light of mutually different color.

9. The light-emitting diode according to claim 1, comprising at least three light-emitting diode chips, each light-emitting diode chip having its own control device, wherein the light-emitting diode chips emit light of mutually different color.

10. A method for producing a light-emitting diode according to claim 1, comprising:

a) sending an electrical test pulse to a data input of one of said at least one control devices for one of said at least one light-emitting diode chips, b) measuring luminous intensity of light emitted by light-emitting diode chip due to the test pulse, c) calculating a correction data wherein a value of the correction data is proportional to a difference between the measured luminous intensity and a target luminous intensity, d) storing the correction data in the data storage device, e) repeating steps a) to d) until the measured luminous intensity matches the target luminous intensity, and f) repeating steps a) to e) for all light-emitting diode chips.

11. The method according to claim 10, wherein the correction data is an 8-bit correction data pulse.

12. A light-emitting diode comprising:

at least one light-emitting diode chip, at least one control device, a carrier for the at least one light-emitting diode chip, wherein each of the light-emitting diode chips is electrically connected to one of said at least one control devices, each of said at least one control devices comprises a data storage device in which brightness data for each light-emitting diode chip which is connected to said control device is stored, the control device drives the connected light-emitting diode chip with a current selected according to stored brightness data for said light emitting-diode chip, each of the light-emitting diode chips is in direct physical contact with one of said at least one control devices, and the at least one control device is integrated into said carrier, wherein said control device is surrounded by said carrier on all sides.

13. A light-emitting diode comprising:

at least one light-emitting diode chip, at least one control device, a carrier for the at least one light-emitting diode chip, wherein each of the light-emitting diode chips is electrically connected to one of said at least one control devices, each of said at least one control devices comprises a data storage device in which brightness data for each light-emitting diode chip which is connected to said control device is stored, the control device drives the connected light-emitting diode chip with a current selected according to stored brightness data for said light emitting-diode chip, each of the light-emitting diode chips is in direct physical contact with one of said at least one control devices, and the at least one control device is said carrier, wherein said control device is surrounded by said carrier on all sides.

14. A light-emitting diode comprising:

at least one light-emitting diode chip, a housing comprising a carrier for the at least one light-emitting diode chip and reflector walls, at least one control device which is a carrier, and a housing comprising the carrier for the at least one light-emitting diode chip and reflector walls, wherein each of the light-emitting diode chips is arranged in the housing, each of the light-emitting diode chips is electrically connected to one of said at least one control devices, each of said at least one control devices comprises a data storage device in which brightness data for each light-emitting diode chip which is connected to said control device is stored, and the control device drives the connected light-emitting diode chip with a current which is selected according to stored brightness data for said light emitting-diode chip.

* * * * *